United States Patent [19]

Babson et al.

[11] 3,973,285

[45] Aug. 10, 1976

[54] METHOD FOR STIFFENING WORKPIECES SUCH AS SHOE COMPONENTS

[75] Inventors: Edward S. Babson, Ipswitch; Robert F. Gorini, Beverly, both of Mass.

[73] Assignee: USM Corporation, Boston, Mass.

[22] Filed: Oct. 28, 1975

[21] Appl. No.: 625,931

Related U.S. Application Data

[62] Division of Ser. No. 538,819, Jan. 6, 1975.

[52] U.S. Cl. ..... 12/146 D

[51] Int. Cl.[2] ..... A43D 00/00

[58] Field of Search ..... 12/146 R, 146 D, 142 R; 36/68

[56] References Cited

UNITED STATES PATENTS

| | | | |
|---|---|---|---|
| 3,316,573 | 5/1967 | Chaplick et al. | 12/146 D |
| 3,647,616 | 3/1972 | Zemlin | 12/146 D |

*Primary Examiner*—Patrick D. Lawson

*Attorney, Agent, or Firm*—Carl E. Johnson; Vincent A. White; Richard B. Megley

[57] ABSTRACT

A method and a machine for stiffening part of a flexible workpiece, such as the toe portion of a vamp, causes it to register with the tacky layer of a correspondingly shaped molten deposit of thermpolastic which simultaneously is being cooled to effect release. The entire deposit is transferred to the selected toe area and smoothly covers any surface irregularities or apertures. The surface receiving the molten deposit is flat and cooled but not recessed so that peripheral portions of the upper layer of the deposit are not chilled as rapidly as its under layer and remain deformable during register of the toe portion therewith. A workholder preferably includes a substantially rigid margin clamping means cooperative with a yieldable work engaging pad, a relatively non-compressed portion of the pad unmasked by the clamping means defining three dimensionally the adhered charge printed onto the work.

3 Claims, 9 Drawing Figures

METHOD FOR STIFFENING WORKPIECES SUCH AS SHOE COMPONENTS

This is a division, of application Ser. No. 538,819, filed Jan. 6, 1975.

BACKGROUND OF THE INVENTION

This invention relates to machines for stiffening portions of flexible material. More particularly it is concerned with providing an improved machine for stiffening selected portions of workpieces such as the toe portions of shoe uppers. While herein shown as well adapted for providing stiffened vamps, it will be understood that features of the invention are of broader utility and have advantage especially where the selected portion to be stiffened is characterized by surface irregularity which, in effect, it is desired to transform and render smooth.

In the prior art a machine having wide acceptance in the shoe industry for applying molten thermoplastic material as a layer adherent to an upper is disclosed in U.S. Pat. No. 3,277,867 issued Oct. 11, 1966 in the names of C. O. Kilham et al. While machines of this type have been successfully employed on different types of work, both lined and unlined, it is found important that a machine have greater versatility in processing certain types of workpieces required to be stiffened, especially those having surface irregularities and/or openings. In the case of vamps, for instance, the irregular surface may occur as a raised seam, either inside or outside, or because of straps or perforations, or simply be uneven surface substances any of which can interfere with application of the thermoplastic in consistantly uniform manner. In some cases the prior means by which, or the prior way in which, the selected area of a workpiece to be coated is presented to an adhesive applicator gives rise to problems for the shoemaker; air, for example, can be trapped between the upper material and the viscous thermoplastic, or the leather may be wiped during application to provide an excess coating in localities that will subsequently harden and consequently prove difficult to last. Improper shoe conforming ultimately leads to uncomfortable wearing.

Some other U.S. patents in the prior art disclosing various machines and different methods of approach pertaining to coating and stiffening flexible sheet material are noted:

U.S. Pat. No. 3,026,573—utilizes injection molding principals.

U.S. Pat. No. 3,316,573—improved shoe stiffening method.

U.S. Pat. No. 3,342,624—a scraper blade moves across a stencil and an opening therein to force coating material into the opening and thus adhere to a shoe part.

U.S. Pat. No. 3,442,743—filling the recess of a mold with thermoplastic, partially hardening the thermoplastic by cooling the mold recess, bringing the mold into alignment with the work, and pressing the mold and work together to secure the molded plastic as a wafer thereon.

U.S. Pat. No. 3,434,170—employs a heat hardenable discrete layer.

U.S. Pat. No. 3,523,814—a fluid coating is deposited on a masked work-piece and an applicator is moved across the mask to straddle a gap therein.

U.S. Pat. No. 3,618,151—molten polymeric material is flowed onto and around threads of a fabric laid on an area to be stiffened.

In various ways these and other earlier attempts have not always been satisfactory in insuring that irregularity in the material to be stiffened, has been satisfactorily coated with thermoplastic and that interior smoothness in the completed product has been attained.

SUMMARY OF THE INVENTION

A main object of this invention is to provide an improved machine for stiffening selected portions of otherwise flexible material by the application of hot melt, and which machine shall be capable of properly operating upon or treating such portions even though they may in part be characterized by an irregular or apertured surface.

Another and more specific object of this invention is to provide an easily operated machine for stiffening shoe components by convenient printing on of molten thermoplastic in a quantity and configuration adequate to smoothly cover any apertures, surface irregularities or indentations and form a coating conducive to subsequent good lasting in a shoe.

A further object of the invention is to provide an improved method for applying stiffening material to the toe portions of shoe uppers.

To these ends, and as herein illustrated, a machine for stiffening a predetermined portion of a shoe upper comprises a platen having a surface corresponding to that portion, means for depositing molten thermoplastic material on the platen, means for cooling the platen to facilitate release of the material deposited thereon, a movable workholder adapted to expose the predetermined shoe upper portion to be stiffened, and means to effect relative movement between the workholder and the platen to register and press the predetermined portion against the molten or at least tacky layer of the deposited charge and then separate the workholder with the full charge printed on the upper.

BRIEF DESCRIPTION OF THE DRAWINGS

The above and other objects and features of this invention will now be more particularly described in connection with a preferred embodiment and with reference to the accompanying drawings thereof, in which.

DESCRIPTION OF PREFERRED EMBODIMENT

Figure 1:
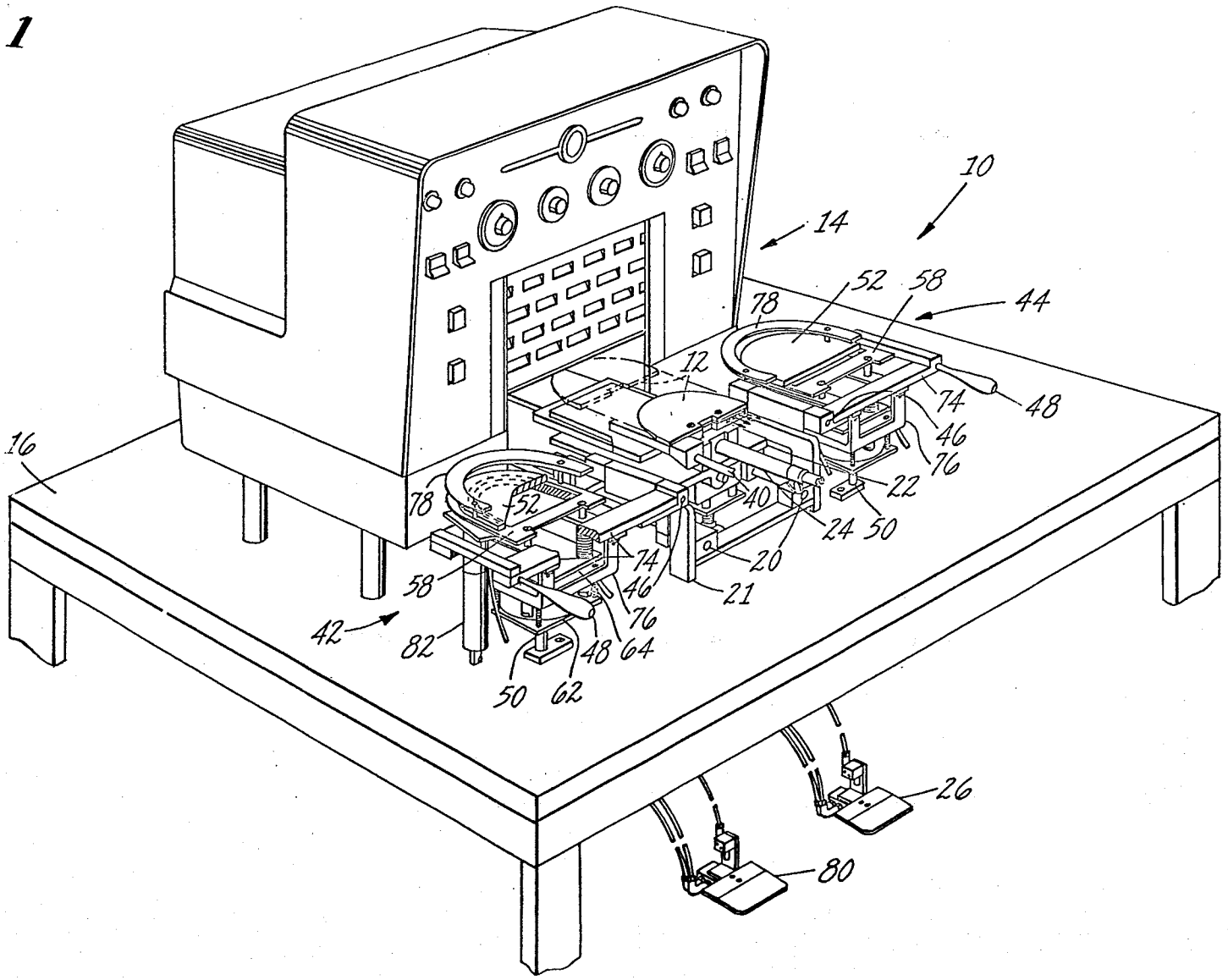
FIG. 1 is a perspective view of an illustrated machine for stiffening the predetermined toe portions of shoe uppers or the like and provided with two loading stations, the parts being shown in their initial rest positions with portions broken away.
Figure 2:
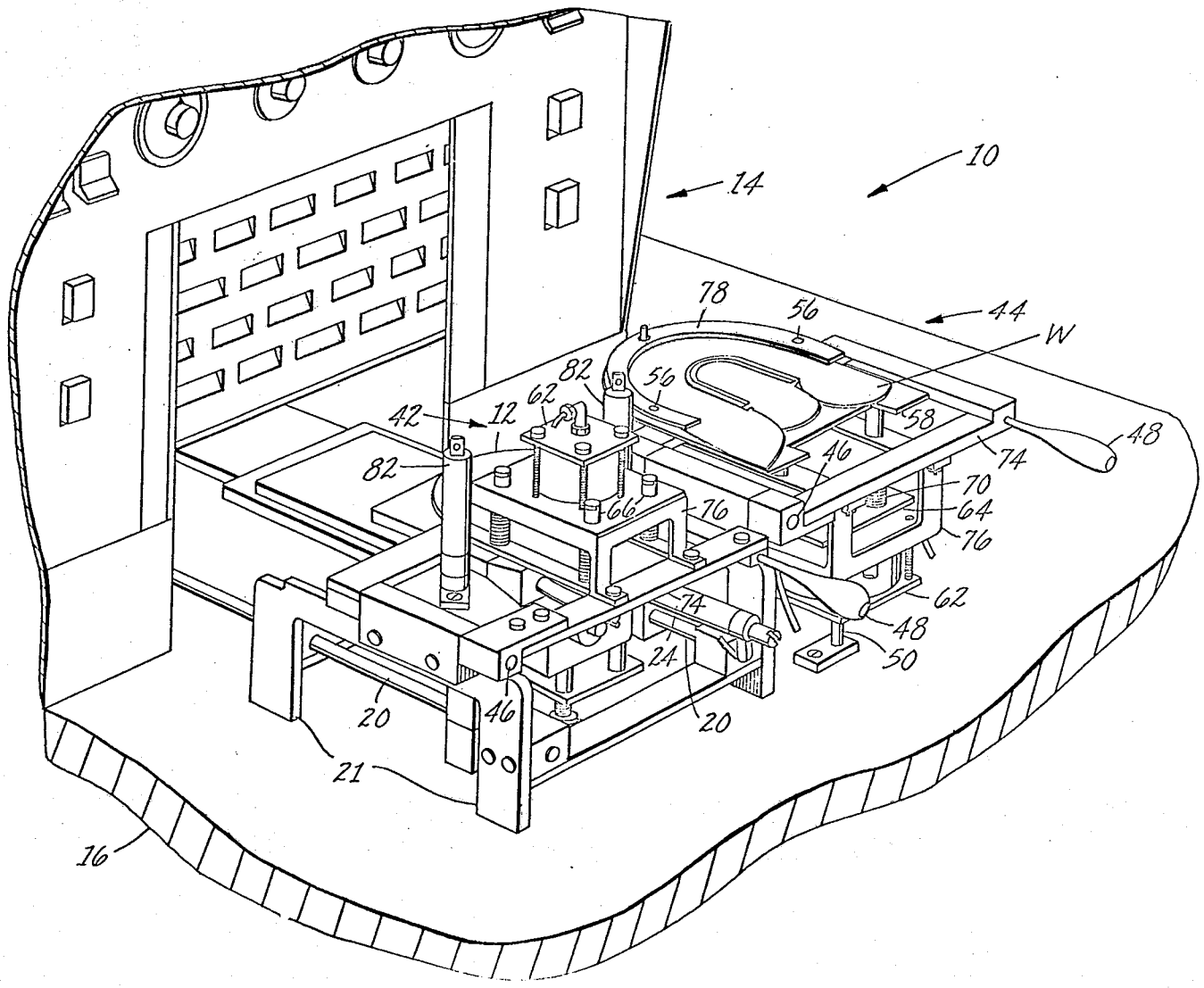
FIG. 2 is a view similar to FIG. 1 but showing a workholder of one of the work loading stations shifted to cooperate with a platen, and the other work station loaded with the next upper to be processed.
Figure 3:
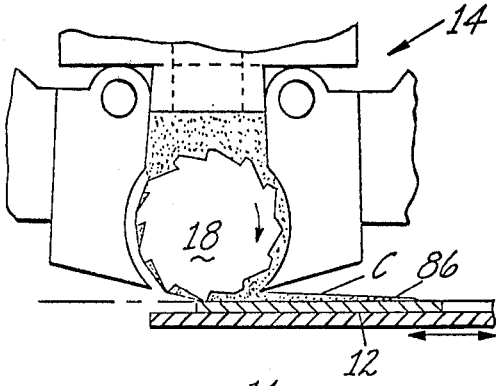
FIG. 3 is a somewhat schematic end view of an applicator device depositing molten thermoplastic on the platen.

Referring to FIGS. 1 and 2 an illustrative machine for practicing the novel method herein disclosed and generally designated 10 comprises a matrix or platen 12 relatively movable with respect to an applicator means generally designated 14 for depositing a charge C of molten thermoplastic or "hot melt" thereon. As herein shown the platen 12 is horizontally reciprocable over a table 16 upon which the applicator means 14 is secured. For thus moving the platen from its initial front and uncoated condition shown in FIG. 1 rearwardly to a charge-receiving position beneath the applicator means, such as under an applicator roll 18 (FIG. 3) of a cement applying device such as fully disclosed in the mentioned Kilham et al U.S. Pat. No. 3,277,867, mechanism under the control of an operator is provided as next described.

A pair of spaced parallel guide rods 20,20 mounted in a stationary subframe 21 affixed to the frame of the applicator means 14 provides fore and aft bearings for a reciprocable carriage 22 detachably supporting the platen 12. In the illustrative arrangement an air-operated spring-return piston-cylinder device 24 (FIGS. 1, 2 and 4) is employed for actuating the carriage, air under pressure being admitted to the cylinder upon actuation of a treadle 26 (FIG. 1) controlling an air valve not shown. It is to be noted that the platen 12 has a flat upper surface of a peripheral shape corresponding to a predetermined portion of a flexible workpiece W (FIGS. 2, 5, 6 and 8) to be stiffened. Platens 12 of other peripheral contour may be substituted on the carriage 22 as deemed appropriate to particular workpieces. While a highly polished, fluid cooled metal alloy platen has generally been found satisfactory, a useful alternate form of metal platen 28 shown in FIG. 7 may have an adhesively secured cover 30 of thin silicone rubber for release of the thermoplastic deposit yet not substantially impeding cooling convection such as may be derived from a circulating fluid. In FIG. 7, for example, the platen 28 is detachably secured as by a pair of screws 32 (one only shown) extending through a thin conductive plate 34, and into a cooling plate 36 having a plurality of ducts 38, U-shaped for instance, formed therein. It will be understood that liquid cooling may be employed, but as illustrated herein air under pressure is continuously supplied from a blower 40 (FIGS. 1 and 4) to flow through the ducts 38 for hastening solidification of an underlying layer of the deposited charge C when the platen is retracted from the roll 18 and for facilitating subsequent release of the entire charge as will hereinafter be explained.

Figure 8:
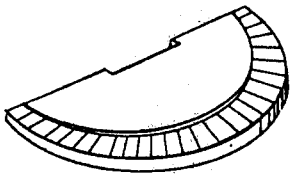
FIG. 8 is a perspective view of an alternative stepped form of platen.

FIG. 8 shows an alternative shape of platen wherein a stepped charge receiving surface is provided. The form shown is useful in assuring a thicker crescent shaped deposit for rendering a portion of the toe area stiffer than the remainder.

The illustrative machine 10 further comprises a pair of work loading and clamping stations 42,44 (FIGS. 1 and 4) next to be described. These right and left-hand stations are substantially identical in structure and function. They are herein shown as being manually (and usually alternately) shiftable from their outside load-unloaded positions indicated in FIGS. 1 and 4 to a central position as indicated in FIG. 2 for the station 42, the charge C (FIGS. 3 and 4) on the platen then being assumed to have a still molten or at least tacky upper layer to be printed onto the predetermined portion of the flexible workpiece W to be stiffened. It will be understood that it is within the scope of the invention to provide only one or a plurality of work loading-clamping stations, that they may be arranged in other relations to the platen when preferred, and that indeed the relative movement of the platen 12 and of the station(s) 42,44 may be sequenced differently and by power means. For present purposes each station is fulcrumed on a horizontal pivot pin 46 (FIGS. 1 and 2) secured in the subframe 21. An outer side of the stations carries a handle 48 by means of which, at the operator's convenience, a station 42 or 44 when suitably loaded in its outer position may be inverted about the pin 46 and thus shifted into registry with the charge C on the retracted platen 12 or 30. In its outer or initial loading position the station 42 or 44 may abut a stop 50 projecting upwardly from the table 16.

Figure 4:
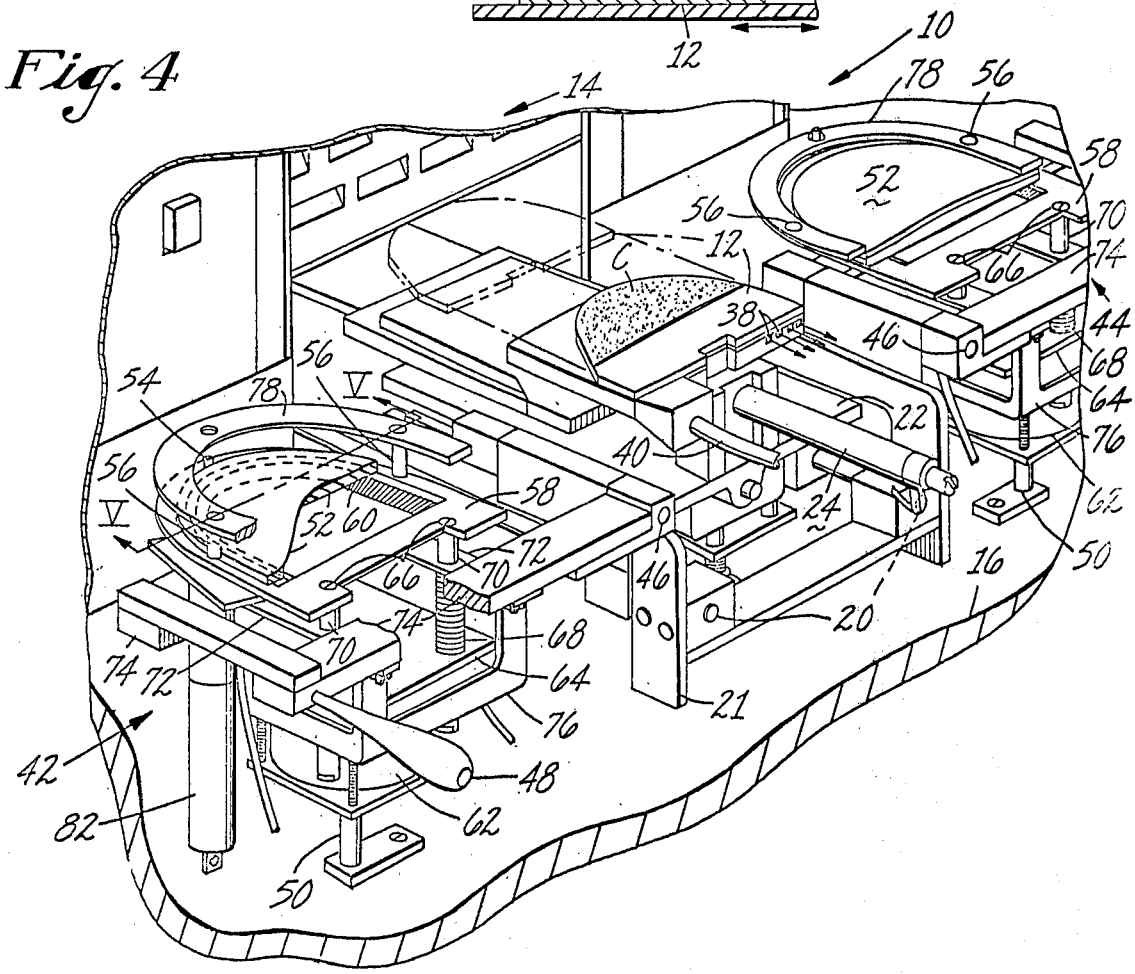
FIG. 4 is a perspective view similar to FIG. 1 but showing the platen retracted with its thermoplastic deposit having an under layer being cooled and an upper face still tacky.
Figure 5:
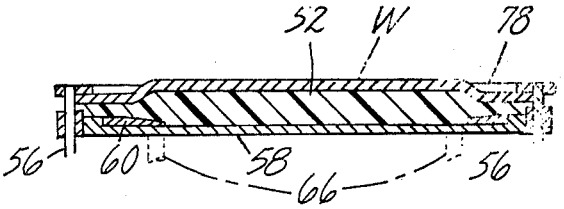
FIG. 5 is a section taken on the line V—V of FIG. 4 and showing the workholder clamping means as initially loaded.

Referring now to the station 42 its structure will be more particularly explained with reference to FIGS. 2 and 4. The workpiece W, such as a toe portion of an upper to be stiffened, is positioned, inside up, upon a compressible pad 52 which may be of foamed rubber or the like and is properly located as by causing it to marginally engage an end pin 54 and opposed side pins 56,56. The latter can also serve as piston rods for a purpose soon to be explained but preferably locating pins are independently provided. The pad 52 rests on a base clamp 58 and a U-shaped band 60 wedge-like in transverse section and nested in the clamp 58. In this case the band 60 is arranged to impose a feather edge in the charge C to be transferred. The clamp 58 is movable heightwise by means of a fluid pressure operated piston-cylinder device 62 when the latter is actuated, a plate 64 connected to the piston being secured to the clamp 58 by means of four screws 66 respectively carrying spacers 68 and return springs 70. This is to say that as indicated in FIG. 4 lower ends of the springs 70 abut the plate 64 and their upper ends engage fore and aft pieces 72,72 secured to levers 74,74 pivoted at their inboard ends on the pin 46. This piston-cylinder device 62 is mounted on a rectangular bracket 76 secured to the levers 74. When the upper W has been positioned as indicated on the pad 52, a margin clamp 78, herein shown in one piece though it might be provided in two or more parts when preferred, is lowered into margin clamping position as shown in FIG. 5. For this purpose a treadle 80 (FIG. 1) is caused to actuate a solenoid valve (not shown) admitting fluid, for instance air, to a pair of cylinders 82 secured to the rear piece 72 for causing their respective piston pins 56,56 to descend and thus urge the clamp 78 cooperatively to clamp the work margin against the periphery of the pad 52 and of the base clamp 58. It will be apparent from FIG. 5 that this margin clamping in the workholder exposes the predetermined portion of the work to be stiffened, and the relatively non-compressed or unmasked predetermined portion is caused by the pad 52 to assume a taut and slightly convex contour. The pad 52 may, for instance, be reduced in thickness by pressure at its margin on the order of about 50%.

Figure 6:
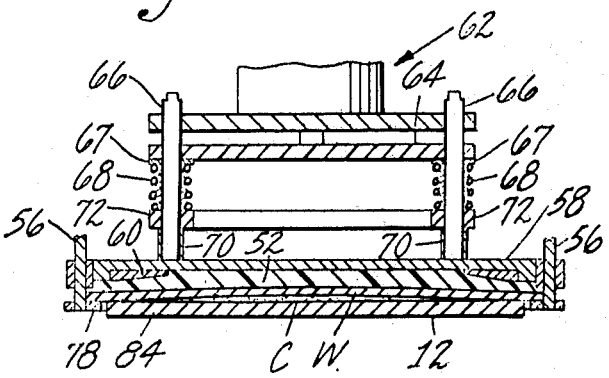
FIG. 6 is a view similar to FIG. 5 but showing the parts inverted at a next stage where printing-on pressure has been applied.
Figure 7:
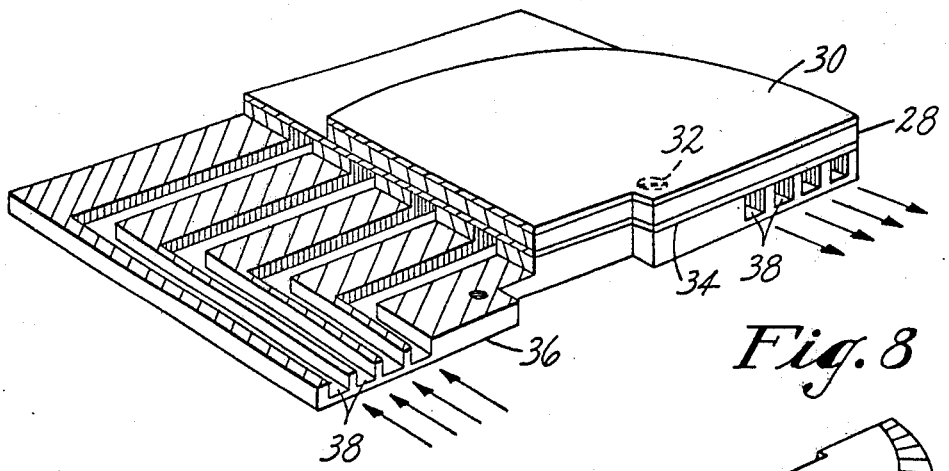
FIG. 7 is a partly sectioned perspective view of a platen assembly adapted for fluid cooling and having a silicone-rubber release covering

Next, after shifting the loaded workholder 42 from its position indicated in FIGS. 1, 4 and 5 to the position shown in FIGS. 2 and 6 wherein the unmasked predetermined portion of the workpiece is registered with and superposed on the molten or at least still tacky upper layer of the charge C, the fluid pressure device 62 is actuated. This may be caused by an automatic timing means or occur on signal from the operator. As a consequence, as shown in FIG. 6, the base clamp 58 is urged downwardly to bring the exposed predetermined workpiece portion into intimate contact with the thermoplastic and enable the platen 12 to print thereon the desired three dimensional thermoplastic charge. In this instance the wedge-sectioned band 60 produces a tapering feather edge 84 in the thermoplastic providing a contour generally recognized as conducive to subsequent good lasting in shoe making. A trailing margin 86 (FIGS. 3 and 9) of the charge C may also have been caused by the roll 18 to taper approximately in the manner taught in the above mentioned Kilham et al patent. The lack of relative lateral movement permitted between the predetermined portion to be printed on and the charge C on the platen avoids risk of distortion. It also is to be noted that since the charge receiving surface 12 or 30 is not recessed, peripheral portions of the upper layer of the charge C are not prematurely chilled and can be squeezed by gradient pressure via the band 60 to provide the tapered feather edge 84.

Figure 9:
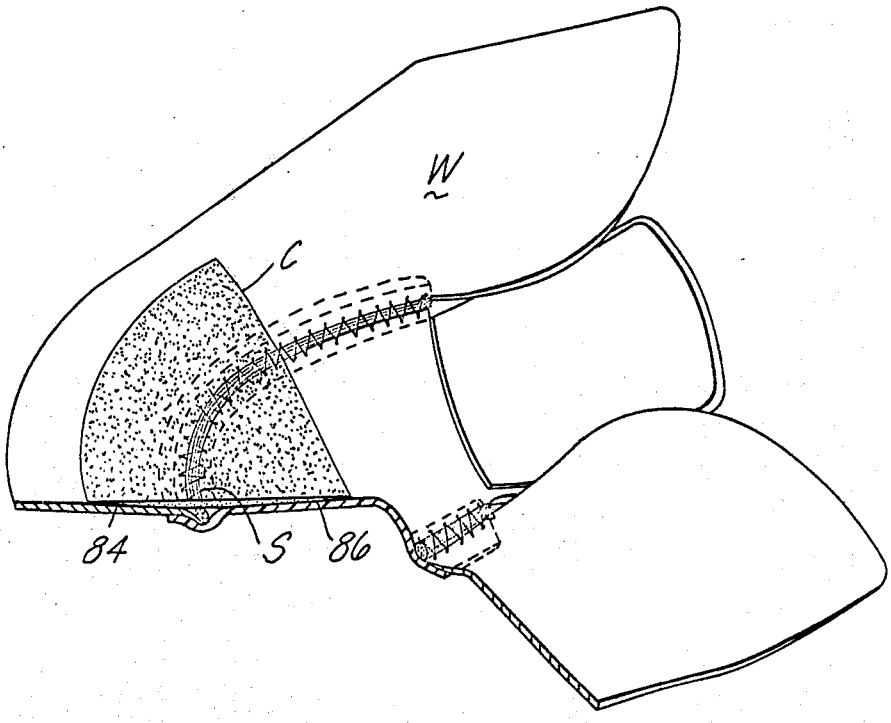
FIG. 9 is a perspective view of a moccasin-type vamp processed in the machine and having surface irregularity due to a raised seam effectively smoothed by stiffening adhesive.

After a suitable, usually short dwell, the operator may give the workholder 42 a return swing about the pin 46, and the printed on charge C, now fully releasable from the platen 12, will be firmly adhered to the upper W. By timed release or otherwise the margin clamp 78 is then relatively lifted and the upper W may be removed with its toe portion properly stiffened. As shown in FIG. 9, a moccasin vamp having a raised seam S, for example, when processed in the machine 10 will, in effect, have its inner recessed surface made smooth by the coating. Similarly, any other irregularities in toe portions of other shoes whether due to perforations, wrinkles or blemishes, for instance, will be rendered smooth and provide no discomfort to the ultimate wearer.

Having thus described our invention what we claim as new and desire to secure as Letters Patent of the United States is:

1. The method of stiffening a predetermined portion of the upper of a shoe or the like which consists in depositing a molten charge of viscous thermoplastic stiffening material on a flat release surface corresponding in shape to that of said portion, cooling the charge in its under layer only in portions in contact with said flat surface and at a rate greater than its upper layer whereby peripheral portions of the latter are not chilled, causing said predetermined portion to be drawn taut and pressed into register and intimate contact with said upper layer while the upper layer is still molten or at least tacky, and then effecting separation of the upper from the release surface with the entire charge adhered to the predetermined portion of the upper.

2. The method of claim 1 wherein, in order to provide the predetermined portion with a tapering marginal thickness in the stiffening material, the margin of the predetermined portion is squeezed uniformly but with graded pressure differential against said surface to an extent greater than other portions thereof while the upper and the surface are in register.

3. The method of claim 1 wherein, in order to impart a desired tapered feather edge in the stiffening material along a selected margin of the predetermined portion of the upper, before said step of pressing the predetermined portion into register and contact with said upper layer, a band substantially corresponding in configuration to said feather edge is disposed on the opposite side of the upper from said release surface and in overlying relation to said selected margin.

* * * * *